US007950406B2

(12) United States Patent
Raniere

(10) Patent No.: US 7,950,406 B2
(45) Date of Patent: May 31, 2011

(54) ATHLETIC COURSE COVERING SYSTEM

(75) Inventor: Keith A. Raniere, Clifton Park, NY (US)

(73) Assignee: First Principles, Inc., Albany, NY (US)

( * ) Notice: Subject to any disclaimer, the term of this patent is extended or adjusted under 35 U.S.C. 154(b) by 597 days.

(21) Appl. No.: 11/456,282

(22) Filed: Jul. 10, 2006

(65) Prior Publication Data

US 2008/0006315 A1 Jan. 10, 2008

(51) Int. Cl.
*E04H 15/10* (2006.01)

(52) U.S. Cl. ..... 135/91; 135/97; 135/124; 135/905; 52/63; 239/279; 472/92; 472/136

(58) Field of Classification Search ..... 135/91–94, 135/97, 121–123, 124, 117, 119, 120.1, 908; 52/86, 63; 239/279–281; 472/92–94, 62, 472/134, 136

See application file for complete search history.

(56) References Cited

U.S. PATENT DOCUMENTS

| | | | | | |
|---|---|---|---|---|---|
| 1,787,631 | A | | 1/1931 | Kitzmiller | |
| 1,923,085 | A | | 8/1933 | Flick | |
| 3,233,617 | A | * | 2/1966 | Stern | 135/158 |
| 3,480,023 | A | * | 11/1969 | McConnell et al. | 135/125 |
| 3,801,093 | A | | 4/1974 | Jones, III | |
| 4,121,604 | A | * | 10/1978 | Rain | 135/124 |
| 4,231,289 | A | * | 11/1980 | Domicent | 454/52 |
| 4,476,809 | A | * | 10/1984 | Bunger | 119/436 |
| 4,649,947 | A | * | 3/1987 | Tury et al. | 135/97 |
| 4,788,791 | A | * | 12/1988 | Sprung | 47/17 |
| 4,815,736 | A | * | 3/1989 | Wright | 473/421 |
| 5,033,489 | A | * | 7/1991 | Ferre et al. | 134/57 R |
| 5,469,587 | A | * | 11/1995 | Demeny | 4/599 |
| 5,613,543 | A | * | 3/1997 | Walton | 160/265 |
| 5,634,638 | A | * | 6/1997 | Havens et al. | 473/421 |
| 5,638,851 | A | * | 6/1997 | Baldwin | 135/124 |
| 5,839,462 | A | * | 11/1998 | Randall | 135/128 |
| 5,921,036 | A | | 7/1999 | Murphy | |
| 6,161,362 | A | * | 12/2000 | Forbis et al. | 52/745.06 |
| 6,175,969 | B1 | * | 1/2001 | Edwards | 4/496 |
| RE37,135 | E | | 4/2001 | Elwell | |
| 6,282,834 | B1 | * | 9/2001 | Mossey | 47/17 |
| 6,488,590 | B2 | | 12/2002 | Katayama | |
| 6,679,009 | B2 | * | 1/2004 | Hotes | 52/86 |
| 6,741,176 | B2 | * | 5/2004 | Ferraro | 340/568.1 |
| 7,131,236 | B2 | * | 11/2006 | Sample et al. | 52/79.5 |
| 7,516,967 | B2 | * | 4/2009 | Schwei et al. | 280/79.2 |
| 2006/0091234 | A1 | * | 5/2006 | Wallander | 239/146 |

* cited by examiner

*Primary Examiner* — Winnie Yip
(74) *Attorney, Agent, or Firm* — Schmeiser, Olsen & Watts, LLP

(57) ABSTRACT

The invention relates generally to a covering system for athletic courses. A movable framework straddles the athletic course and serves as a support for a cover. Inside, lighting and climate may be controlled. Also, possibly as a training aid or to facilitate competitive events, a timing system and/or PA system may be incorporated. Among the possible athletic courses suitable for covering are running courses, in-line skating courses, cycling courses, etc. The invention also includes a method of operating an outdoor exercise course.

14 Claims, 3 Drawing Sheets

ATHLETIC COURSE COVERING SYSTEM

BACKGROUND OF THE INVENTION

1. Technical Field

The invention relates generally to a system for covering an athletic course, such as a running course, an in-line skating course, a horse back riding course, or a cycling course.

2. Related Art

Athletically performing outdoors, whether for training or in competition, has several drawbacks. The weather makes outdoor athletic performance difficult. Precipitation, humidity, temperature, and wind all affect the athlete's performance, as well as, the surface on which the athlete is performing. Another shortcoming of the weather is its unpredictability. Thus, the vagaries and uncontrollability of the weather add an unknown variable to the mix, making it difficult both for the athlete to effectively train and to monitor an athlete's program. Whether it is running, cycling, or in-line skating, outdoor athletics on roadways also has the drawback of the danger of vehicular traffic as well as the poor quality of the roadway surface (i.e., potholes, cracks, debris, etc.). Similarly, while indoor courses for these various athletic endeavors overcome many of the aforementioned shortcomings, there are other deficiencies associated with indoor athletic courses. A chief deficiency of indoor athletic courses (e.g., indoor running ovals, velodromes, etc.) is that they are short and highly repetitive and, thus, boring to train and perform upon. A need exists for improvements in athletic courses, and to overcome various deficiencies, including those mentioned above.

SUMMARY OF THE INVENTION

In a first general aspect, the present invention provides a movable covering for athletic courses. This covering isolates and protects the athletic course from outside environmental conditions. A second general aspect is a customizable environmental system. With the athletic course isolated from the outside environment by a covering, climate control systems may provide an environment inside of the athletes' choosing.

The foregoing and other features and advantages of the invention will be apparent from the following more particular description of embodiments of the invention. It is to be understood that both the foregoing general description and the following detailed description are exemplary, but are not restrictive, of the invention.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE INVENTION

Figure 1:
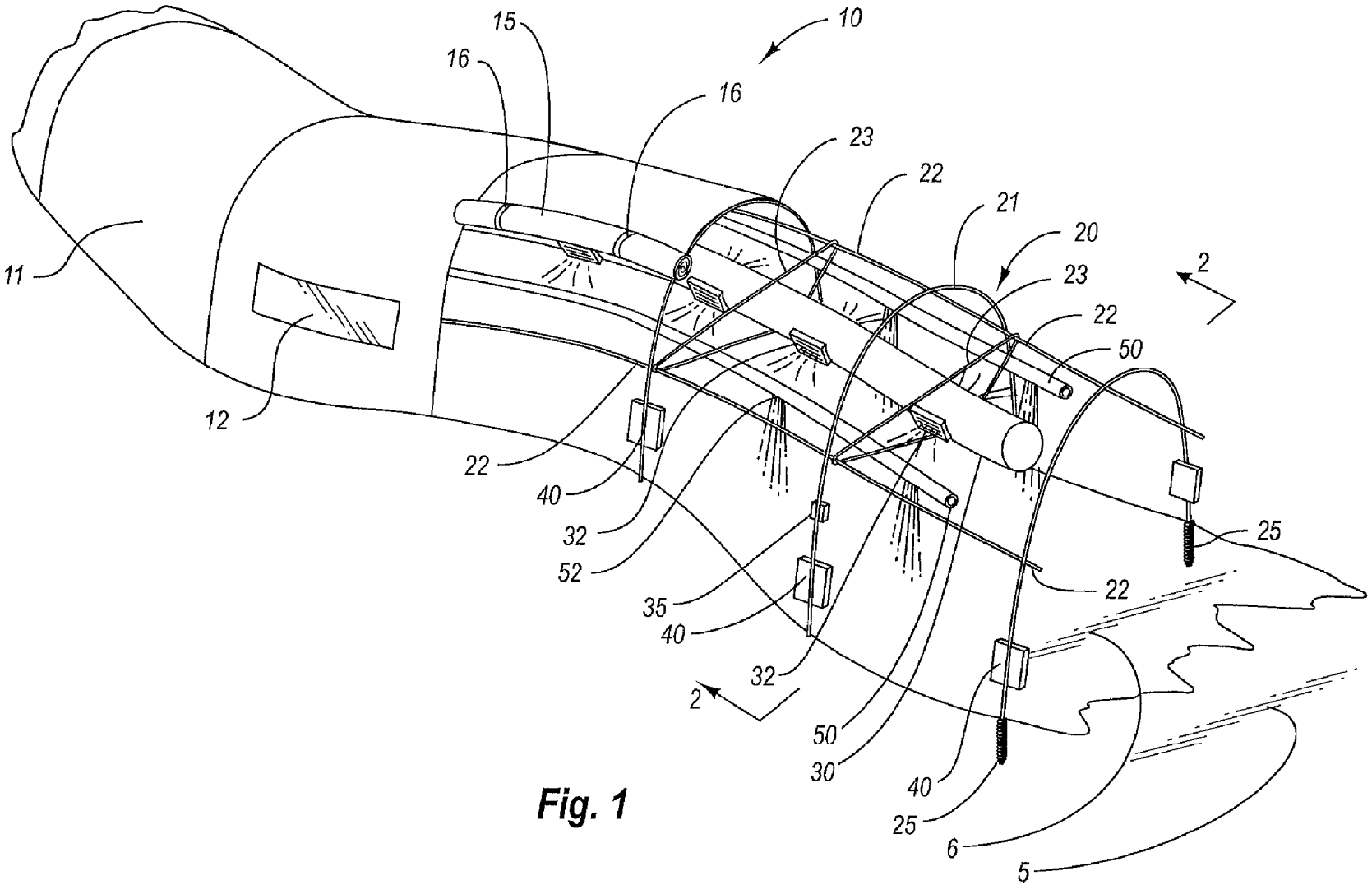
FIG. 1 is a perspective view, partially cutaway, illustrating a portion of an embodiment of a cross-country running course covering system, in accordance with the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

The present invention is a system for athletic courses, denoted by a 10. The system 10, herein also termed an athletic course covering system 10 includes several sub-systems or elements. Although in the following disclosure, including the figures, the system 10 is discussed in its use as a system 10 for cross-country type running, it should be apparent to one in the art that the system 10 could also serve a useful purpose for other athletic endeavors. These include in-line skating courses, cycling, and horse-back riding.

Turning to FIG. 1, which is a perspective view of a section of the system 10 with a portion of the system 10 removed for illustrative purposes, the system 10 may include a framing system 20 which spans, in whole or in part, a portion of a ground surface 5. An athletic course surface 6 may be the portion of the ground surface 5 that the framing system 20 spans. On the framing system 20 may be a cover 11.

Figure 3:
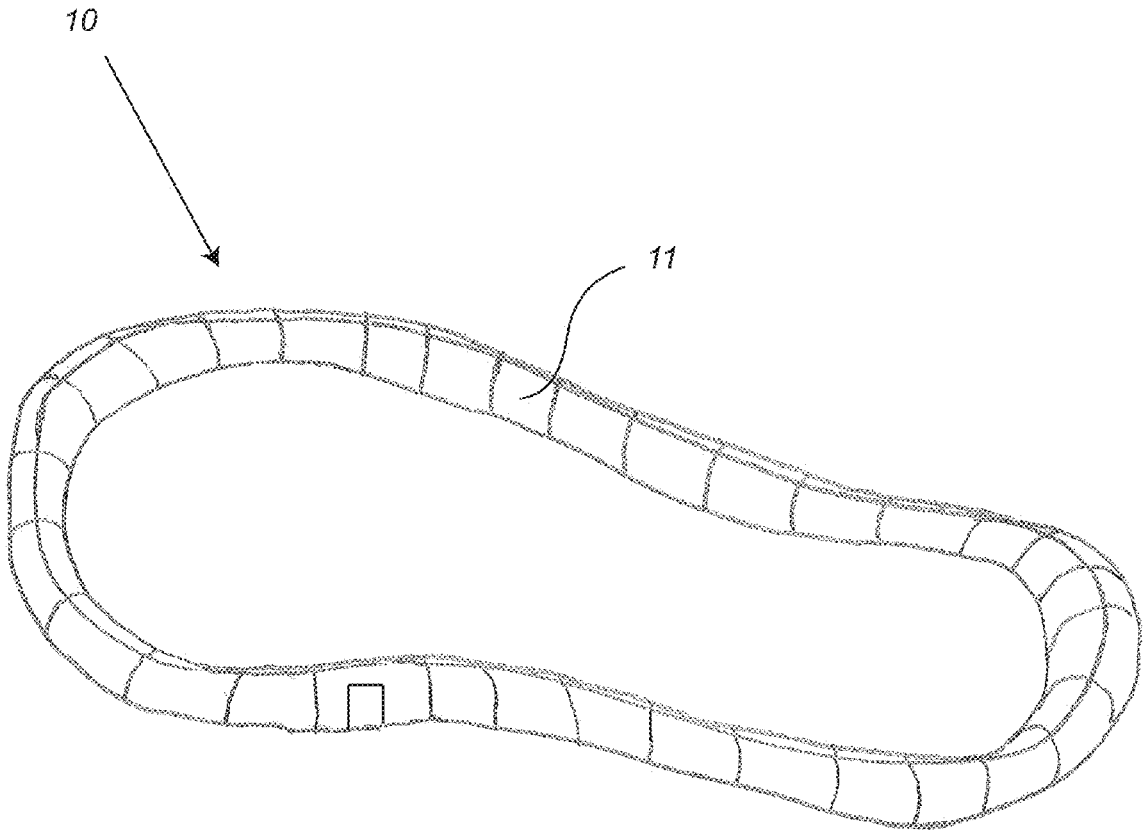
FIG. 3 is a perspective view illustrating the cross-country running course covering system course in accordance with the present invention.

The framing system 20 and cover 11, thus, span over the athletic course surface 6. The athletic course surface 6 may be an improved surface such as asphalt, concrete, synthetic track surface, wood chips, wood, or gravel. Likewise, the athletic course surface 6 can be an unimproved course of any type. The course surface 6 can be a circuitous path that may form a closed loop course, shown in FIG. 3. The course surface 6 can also be an open-looped course, or just a section of a running course. Thus, the system 10 has an advantage of providing cover, total or partial, to the athletes while they are performing. The system 10 provides this cover whether the course changes elevation and/or direction.

The framing system 20 may be attached to the ground surface 5 at various locations. The framing system 20 may be made of metal, composite, wood, plastic, or other suitable materials. The framing system 20 may be a series of frames 21 that are attached to the ground surface 5 at a plurality of foundation attachment points 25 via snaps, clips, or screws. The frames 21 may be hoop-type, polygonal, or any combination thereof. The foundation attachment points 25 may be attached to the ground surface 5 by anchoring which may include "manta ray" plate anchors, "rock anchors" for rock embedment, single and double helix anchors augered into place, and rods or chains anchored into a poured structural fill. The plurality of frames 21 may be attached to each other in order to increase the structural integrity of the system 10. Furthermore, frames 21 may be movable to various foundation attachment points 25 on the ground surface 5. This may provide variation in the course.

Attached to the framing system 20 may be a cover 11. The cover 11 may be made of suitable weather-resistant material. For example, the cover 11 may be made of canvas, cloth, glass, plastic, Gore-Tex®, or other suitable material that can prevent, or minimize, inclement weather from affecting the athletes 100. The cover 11 may be of a single material, or a combination of materials. For example, portions of the cover 11 could be made out of canvas, while other portions of the cover 11 could be made into windows 12, or openings, thereby allowing sunlight to reach the athletic surface 6 and athletes 100, as well as, affording spectators, coaches, and the like to view the athletes 100 from outside the system 10.

Similarly, portions of the cover 11 may have a feature which allows for convertibility of the cover 11. Thus, for example, a portion of the cover 11 may be a rolled-up cover 15. This feature can be used when, for example, the weather may be temperate and the athletes 100 wish to allow the outside weather to touch the athletes 100. The rolled-up cover 15 can be held out of the way via a series of latching devices 16 which connect the rolled-up cover 15 to be held to a series of horizontal elements 22 in the framing system 20. Optionally, rather than a rolled-up cover 15, rigid panels may be used. The panels may be removably attached (i.e. clip-on), or movable while remaining attached (i.e. folding, sliding, etc.) or a combination thereof.

Figure 2:
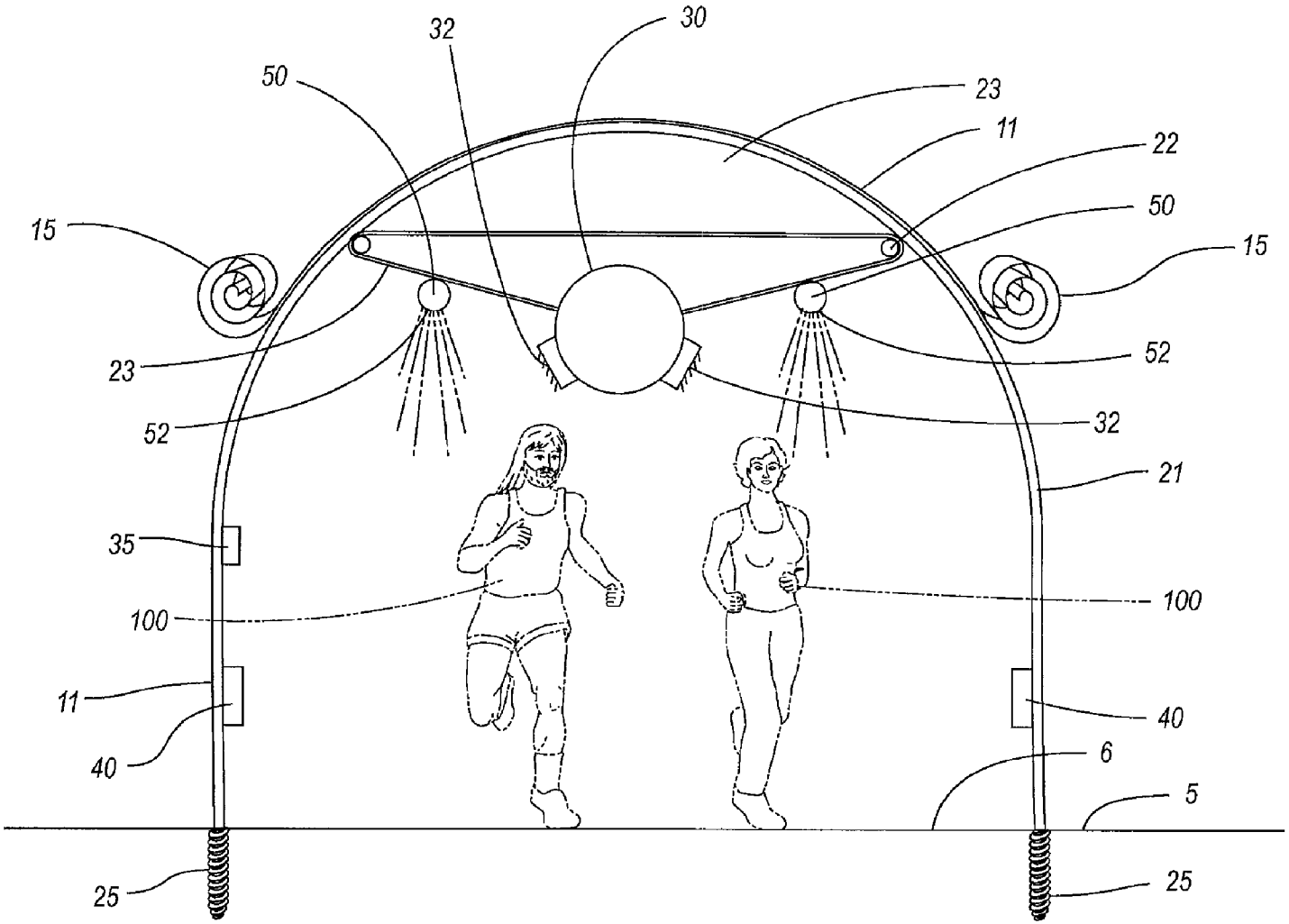
FIG. 2 is a sectional view taken along line 2-2 in FIG. 1.

FIG. 2 depicts a sectional elevation view of a portion of the covering system 10. A system of cabling 23 may be attached to the horizontal elements 22 of the framing system 20. The cabling 23, or cables, may be made of stainless steel cable, or other suitable weather-resistant material. Each frame 21 may have a cabling 23 element attached to it. From the cabling element 23 may be attached a plurality of electro-mechanical systems.

A first electro-mechanical system that may be attached to the cabling 23 is a heating and/or cooling system. For example, as depicted in the embodiment in FIG. 2, a flexible HVAC duct 30 may be suspended via the cabling 23 over the center portion of the athletic surface 6. The HVAC duct 30 may be made of a suitable material such as flexible plastic ductwork. The HVAC duct 30 may have a plurality of openings 32 from which heating or cooling may be provided, depending on the desired temperature sought by the athletes 100. The HVAC duct 30 communicates with an appropriate thermostat (not shown) and a heating and/or cooling source(s) (not shown). An athlete 100 may then set the desired temperature for the athletic course 6. For example, suppose the athlete 100 is using the athletic course 6 and system 100 in January in upstate New York, the athlete 100 may set the thermostat so that heat is provided in the system 10 so that the athletic course 6 is at a temperature of approximately 60° F. This provides the athlete 100 with greater comfort while running on the athletic course 6. Just as the athlete 100 may adjust the HVAC system to provide greater comfort, likewise the athlete 100 may artificially adjust the HVAC system so that a greater impediment is created than the local weather is provided. So too for example, if the athlete 100 (again in New York) is training in preparation for a road race in Arizona, the athlete 100 may adjust the HVAC system so that the HVAC duct 30 is making the athletic course 6 much hotter than the ambient conditions. Heating may be provided by means not integral to an HVAC system such as electrical resistance, hot water radiator, steam, solar, etc. Likewise, cooling may be provided by means not integral to an HVAC system such as local air conditioning units, evaporative coolers, fans, etc.

A second electro-mechanical system that may be attached to the cabling 23 is a misting system. The misting system uses at least one misting pipe, or line, 50 in which a plurality of nozzles/openings 52 extend therefrom. The plurality of nozzles/openings 52 sends water mist on the athletes 100. This helps the athletes 100 stay comfortable while training on the athletic surface 6 by keeping them cooler than were there no misting system. The misting system, depending on its design, could be adjustable so that, instead of emitting a water mist, the droplet size from the nozzles/openings 52 could be enlarged so that, in essence, rain is emitted from the nozzles/openings 52. Thus, a simulated rain, or rain storm, could be created on the athlete 100.

A third electro-mechanical system that may be attached to the cabling 23 is a lighting system. The lighting system includes a plurality of lights 40. The lights 40 may be attached to various portions of the system 10, such as the frames 21, cabling 23, or horizontal elements 22. The lights 40 may be suitable weather-resistant lights such as fluorescent, mercury vapor, metal halide, and the like. The lighting system provides additional lighting beyond the ambient background light so that the athlete 100 has improved vision while using the athletic surface 6.

Environmental conditions in a given section of an athletic course 6 may differ from those in another section. Section by section control of environmental conditions may be used to provide athletes on the course with different environmental conditions. One, several, or all of the electro-mechanical systems may be operatively attached to a series of motion sensors 35. The motion sensors 35, when activated by the exercising athlete 100, can activate one, or more, of the electro-mechanical systems. In this manner, the lights 40, for example, can be switched on only while an athlete 100 is at, or near, that portion of the system 100. Thus, the lights 40 can be turned off in the portion(s) of the athletic surface 6 on which there are no athletes 100. Similarly, the misting system can be coupled to the motion detectors 35. The misting, rain, heating, or cooling effect can then be turned on and off via the motion detectors 35 as the athletes 100 near the requisite portion of the athletic surface 6. For example, one athlete may be running in a mist in low light while another athlete may be running in hot, brightly-lit conditions. Sensors 35 may be used to track an athlete's position along the course. Ahead of the athlete 100, environmental conditions of the athlete's choosing may be prepared for the approaching athlete.

What is claimed is:

1. A covering system comprising:

a circuitous elongated exercise course configured for an athletic activity selected from the group consisting of running, cycling, and in-line skating;

an elongated framing system adapted to straddle the elongated exercise course, wherein said elongated framing system comprises a plurality of sections, each section straddling a length of the elongated exercise course, wherein the entire elongated framing system straddles substantially the entire elongated exercise course;

a customizable environmental control system in each of said plurality of sections, wherein the customizable environmental control system is configured to independently control an environmental condition in each particular section of the elongated framing system and corresponding length of the elongated exercise course that the section straddles;

a plurality of motion detectors, each motion detector attached to a different section of the elongated framing system, wherein the customizable environmental control system is configured to modify the environmental condition in response to motion being detected; and a cover removably attached to said framing system, and extends to cover substantially the entire elongated exercise course when the cover is attached.

2. The covering system of claim 1, wherein said customizable environmental control system further comprises at least one utility system and said framing system is further adapted to support said at least one utility system.

3. The covering system of claim 2, wherein said control system includes at least one utility system attached to said framing system.

4. The covering system of claim 3, wherein said at least one utility system is one selected from the group consisting of a heating ventilation air conditioning HVAC system, a lighting system, a heating system, a cooling system, a hydrating system, a timing system, a personalized amplification PA system, and combinations thereof.

5. The covering system of claim 4, wherein said heating ventilation air conditioning HVAC system includes a flexible duct.

6. The covering system of claim 4, wherein said hydrating system includes a misting tube.

7. The covering system of claim 1, wherein a side portion of said cover includes at least one panel which may be rolled, removable, sliding, clip-on, and foldable.

8. The covering system of claim 1, wherein said framing system includes a cabling subsystem.

9. The covering system of claim 1, wherein said framing system is anchored below a ground surface.

10. The covering system of claim 1, wherein said exercise course has a change in elevation.

11. A method of operating an outdoor exercise course comprising:

providing a circuitous elongated exercise course configured for an athletic activity selected from the group consisting of running, cycling, and in-line skating;

applying a covering system over said exercise course including:

a framing system adapted to straddle said exercise course, wherein said framing system includes a plurality of sections, each section straddling a length of the elongated exercise course, wherein the entire framing system straddles substantially the entire elongated exercise course;

providing a mist system for each of said sections;

providing a motion detection system in operable communication with said mist system;

detecting motion in at least one of said sections; and modifying the mist generation in response to detected motion in the one of said sections.

12. The method of claim 11, wherein the covering system includes:

a cover removably attached to said framing system.

13. The method of claim 11, wherein said exercise course is circuitous.

14. A system comprising:

a circuitous elongated exercise course;

a framing system adapted to straddle the circuitous exercise course wherein said framing system comprises a plurality of sections, each section straddling a length of the circuitous elongated exercise course, wherein the entire framing system straddles substantially the entire elongated exercise course;

a customizable environmental control system in each of said plurality of sections configured to independently control an environmental condition in each particular section of the elongated framing system and corresponding length of the elongated exercise course that the section straddles, the customizable environmental control system including a motion sensor in each particular section configured to automatically customize the environment in each particular section in response to detected motion in each particular section; and a cover removably attached to said framing system and extends to cover substantially the entire elongated exercise course when the cover is attached.

* * * * *